US006702192B2

(12) United States Patent
Igwemezie

(10) Patent No.: US 6,702,192 B2
(45) Date of Patent: Mar. 9, 2004

(54) RAIL RETAINING DEVICE

(75) Inventor: Jude O. Igwemezie, 1020 Denison Street, Suite 207, Markham, Ontario (CA), L3R 3W5

(73) Assignee: Jude O. Igwemezie, Brampton (CA)

( * ) Notice: Subject to any disclaimer, the term of this patent is extended or adjusted under 35 U.S.C. 154(b) by 88 days.

(21) Appl. No.: 09/834,094

(22) Filed: Apr. 12, 2001

(65) Prior Publication Data

US 2002/0000475 A1 Jan. 3, 2002

Related U.S. Application Data

(63) Continuation-in-part of application No. PCT/CA99/00966, filed on Oct. 13, 1999.

(30) Foreign Application Priority Data

Oct. 14, 1998 (CA) ..... 2270299

(51) Int. Cl.[7] ..... E01B 13/00
(52) U.S. Cl. ..... 238/338; 238/351
(58) Field of Search ..... 238/338, 310, 238/336, 349, 351, 352, 355, 378, 292

(56) References Cited

U.S. PATENT DOCUMENTS 3,021,076 A * 2/1962 Finch ..... 238/321
4,688,719 A * 8/1987 Young et al. ..... 238/351
5,605,284 A * 2/1997 Young ..... 238/351
5,735,458 A * 4/1998 Brown et al. ..... 238/343

FOREIGN PATENT DOCUMENTS

| | | | |
|---|---|---|---|
| AU | B-66581/90 | 5/1991 | |
| FR | 2 427 429 | 12/1979 | |
| GB | WO-96/23107 A1 * | 8/1996 | |
| WO | WO 93/12295 | 6/1993 | |
| WO | WO 93/12296 | 6/1993 | |
| WO | WO 96/23107 | 8/1996 | |
| WO | WO 9623107 A1 * | 8/1996 | ..... E01B/9/48 |
| WO | WO 97/30224 | 8/1997 | |
| WO | WO 97/30225 | 8/1997 | |
| WO | WO 97/36055 | 10/1997 | |
| WO | WO 99/04094 | 1/1999 | |
| WO | WO 00/22235 | 4/2000 | |

* cited by examiner

*Primary Examiner*—S. Joseph Morano
*Assistant Examiner*—Frantz F. Jules
(74) *Attorney, Agent, or Firm*—Marks & Clerk

(57) ABSTRACT

A rail retaining device has a shoulder member for bearing on a lateral side of a rail flange. The shoulder has a downwardly facing abutment surface. A rail clip is of bent rod symmetrical about a vertical plane. The clip has an inner portion bearing on the flange, intermediate limb portions reacting with the abutment surface and flexed resiliently downwardly in the installed position, and an outer portion connected to each intermediate limb portion and extending arcuately outwardly and downwardly to a lower portion adapted to bear on a bearing surface.

6 Claims, 5 Drawing Sheets

RAIL RETAINING DEVICE

CROSS-REFERENCE TO RELATED APPLICATION

This application is a continuation-in-part of application PCT/CA99/00966 filed Oct. 13, 1999.

BACKGROUND OF THE INVENTION

The present invention relates to rail retaining devices for incorporation in a rail track.

BRIEF SUMMARY OF THE INVENTION

The invention provides a rail retaining device comprising a shoulder member for bearing on a lateral side of a rail flange, and providing a downwardly facing abutment surface, and a rail clip in the form of a bent rod symmetrical about a vertical plane for extending laterally of the rail and having an inner portion for bearing on an adjacent flange in an installed position, intermediate limb portions for bearing upwardly on the downwardly facing abutment surface, and an outer portion connected to each intermediate limb portion for extending outwardly from said abutment surface and curving laterally arcuately outwardly and downwardly toward a lower portion adapted to bear on a bearing surface, and wherein in said installed position there is a reaction between the intermediate limb portions and the downwardly forcing abutment surface flexing the intermediate limb portions resiliently downwardly.

The arrangement of the invention provides excellent stress distribution and avoids stress concentrations that can contribute to premature failure in known clips. Further, the clip is compliant and tolerant of dimensional variation in the components and is relatively easily to install, while providing a highly effective and durable rail retaining function.

Preferably, the lower portion of the clip is adapted to bear on a bearing surface at a region that is offset laterally inwardly from a centre of curvature of the outer portion. This further improves the stress distribution through the clip in service.

In a preferred form, the inner portion comprises an upwardly bowed portion adjacent the abutment surface that provides increased resistance to migration of the clip outwardly from its installed position as a result of impacts or vibration encountered in service.

Preferably, each lower portion of said outer portions inclines longitudinally with respect to said vertical plane, whereby squatting of the outer portion is facilitated during installation, rendering the clip particularly compliant and facilitating installation.

BRIEF DESCRIPTION OF THE SEVERAL VIEWS OF THE DRAWINGS

Examples are described in more detail hereinafter, by way of example, with reference to the accompanying drawings.

DETAILED DESCRIPTION OF THE INVENTION

Figure 1:
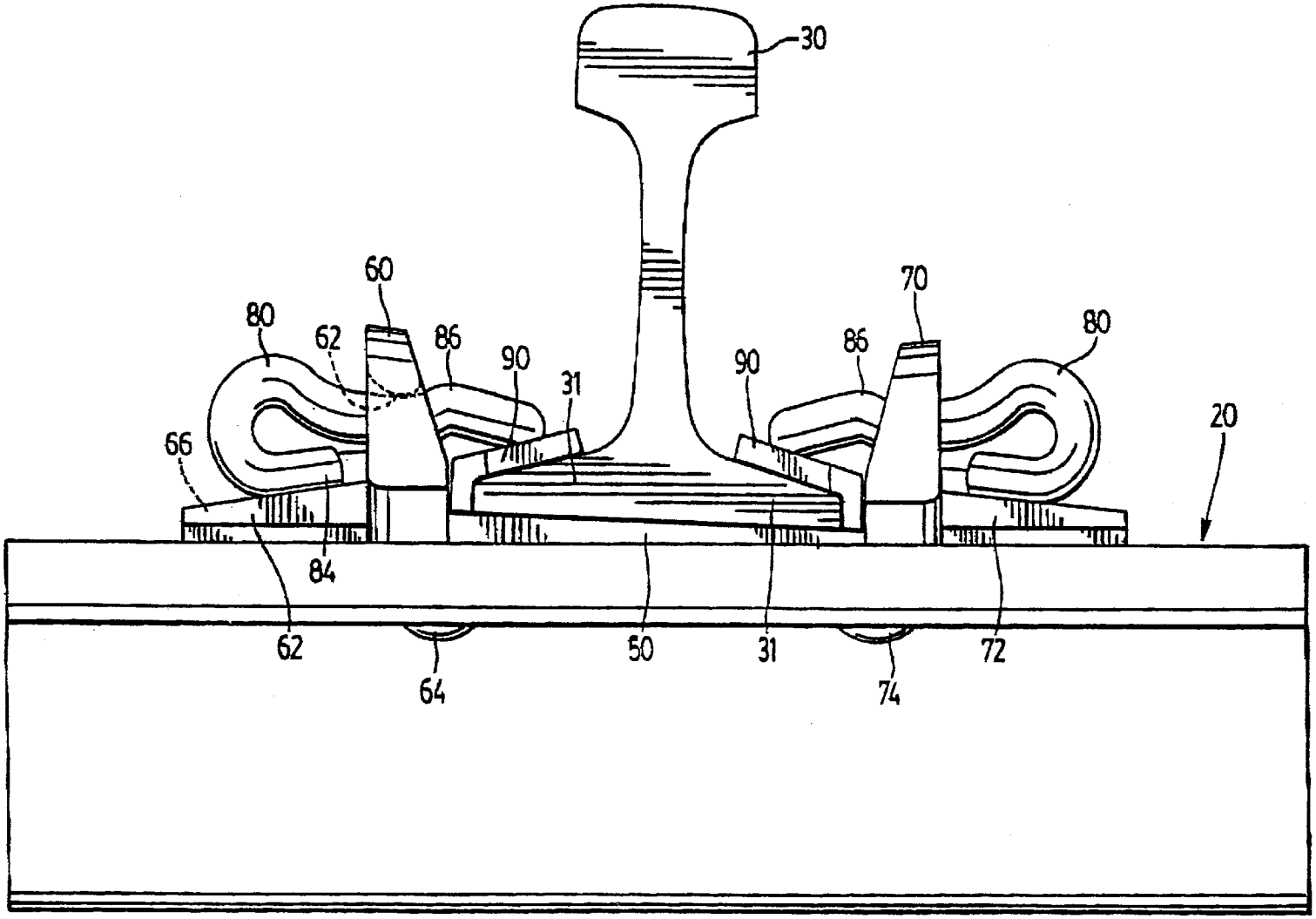
FIGS. 1, 2 and 3 show side, top and isometric views of installed rail retaining devices in accordance with a first embodiment of the present invention.
Figure 2:
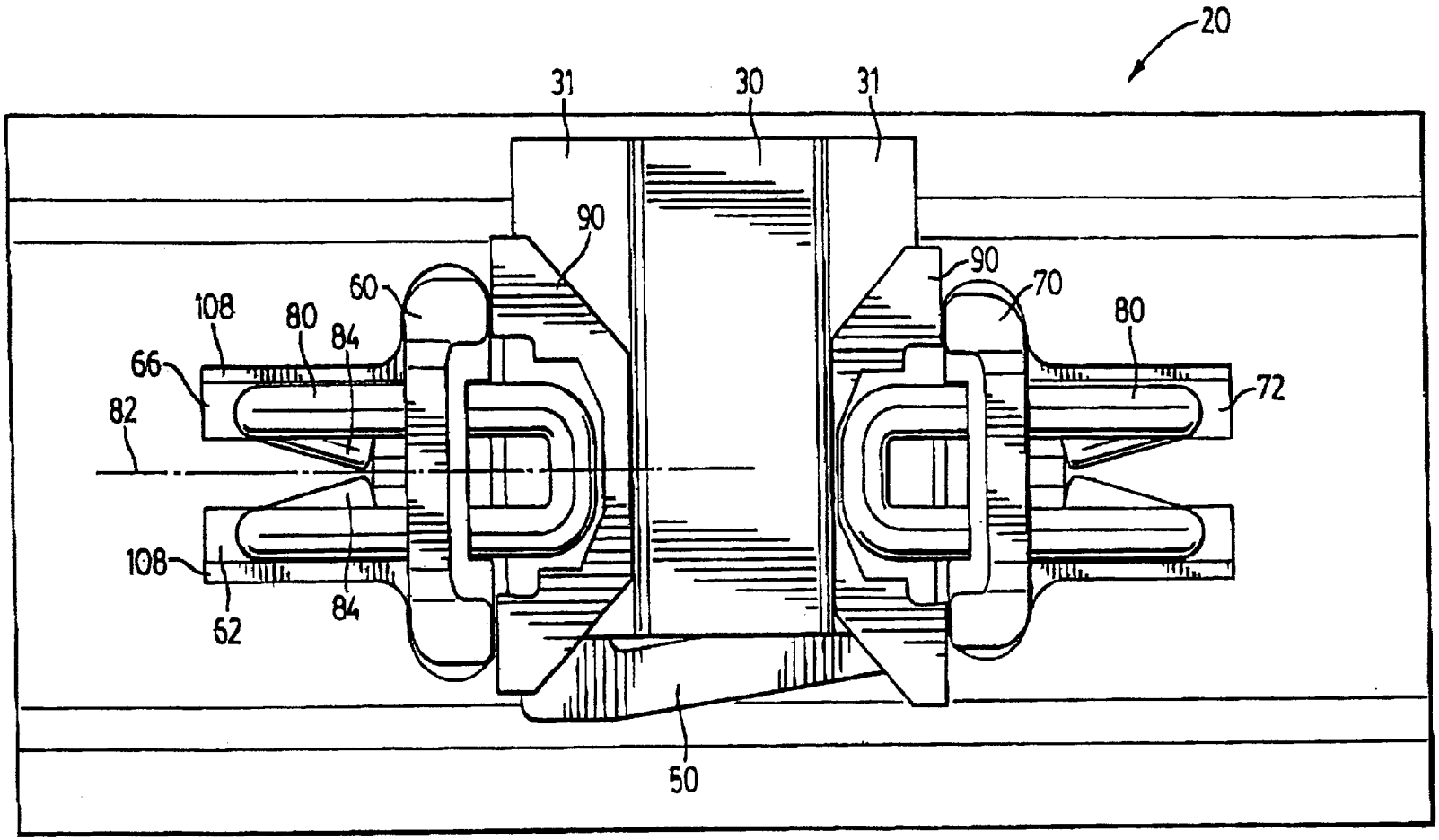
Figure 3:
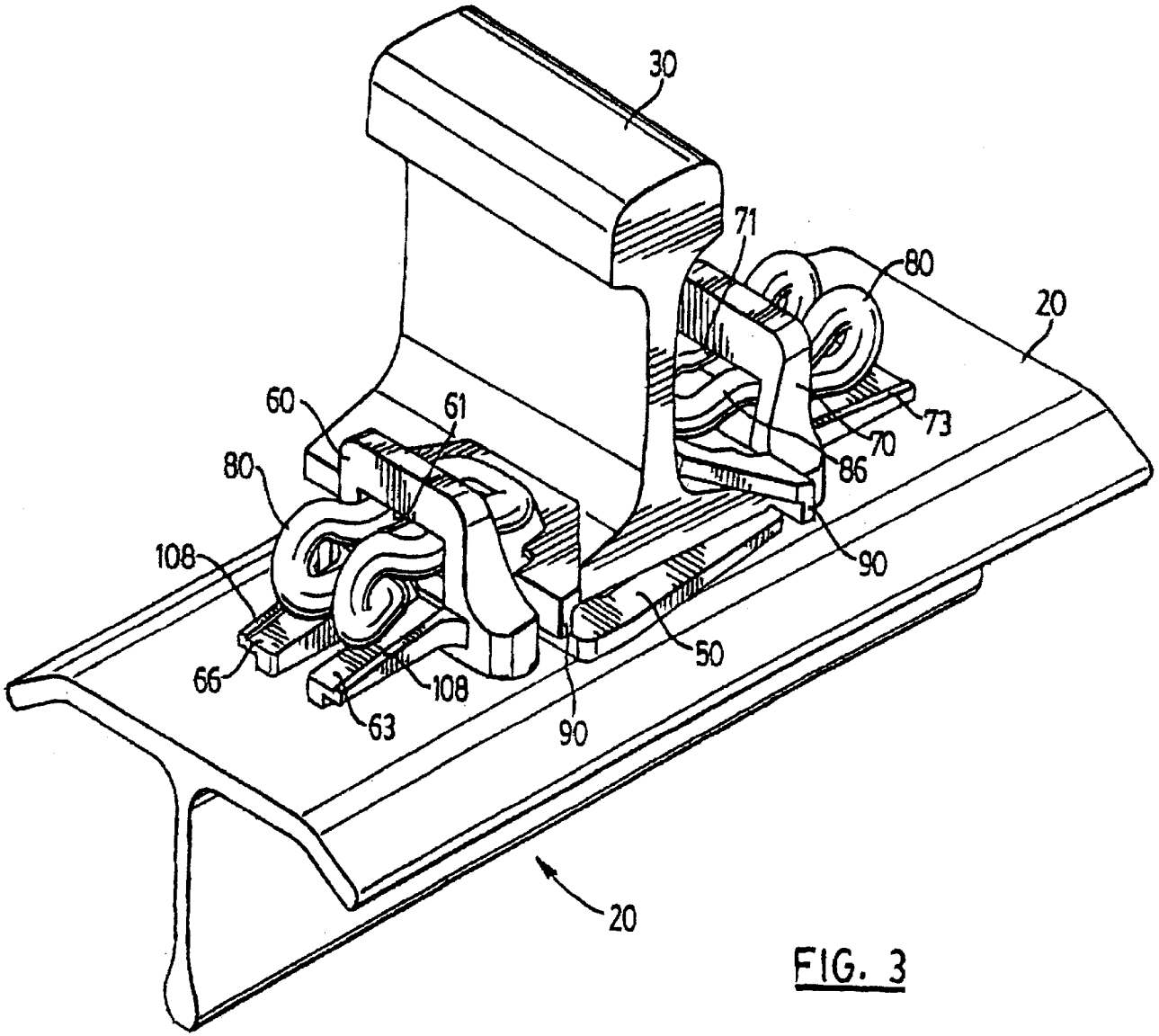

Referring to the drawings, wherein like reference numerals indicate like parts, FIGS. 1 to 3 show a fastening arrangement employing a steel tie 20, electrically insulating cant plate 50 and hook-in field and gauge shoulder members 60 and 70, respectively, these elements being generally as and installed as described in, applicant's published application WO 96/23107, which should be referred to for further details and the disclosure of which is incorporated herein by reference.

While the clips described herein are preferably employed with the above described shoulder members, it is contemplated they may be used with other shoulder members providing a downwardly facing abutment surface.

In the installed position, as seen in FIGS. 1 to 3, clips 80 extend through openings 61 and 71 in the shoulder members 60 and 70, respectively, and bear upwardly on a downwardly facing abutment surface provided on an upper side of the opening 61 or 71, for example on surface 62 as shown in broken lines in FIG. 1. An end portion 81 of the clip 80, disposed laterally inwardly of the clip 80 with respect to a rail 30 bears on a rail flange 31 either directly, or, more usually, through an electrical insulator pad 90 interposed between the rail flange 31 on the one hand and the clip 80 and the shoulder 60 or 70 on the other.

A laterally outer end of the clip 80 engages on a bearing surface, for example a laterally outer extension 63 or 73 of the shoulder 60 or 70. Preferably, the upper surface of the extensions 63 or 73, as well as the lower side of the opening 61 or 71, inclines upwardly laterally inwardly to provide an inclining ramp surface facilitating installation by guiding the clip 80 upwardly on to the upper side of the flange 31.

Also visible in FIG. 1 are the hook-in leg portions 64 and 74 formed integrally with shoulders 60 and 70, respectively, and that are passed through openings in the tie 20 and secure the shoulder portions 60 and 70, to the tie 20 For details of the arrangement of the hook-in leg portions and of the openings in which they are received, reference should be made to WO 96/23107 referred to above.

Figure 4:
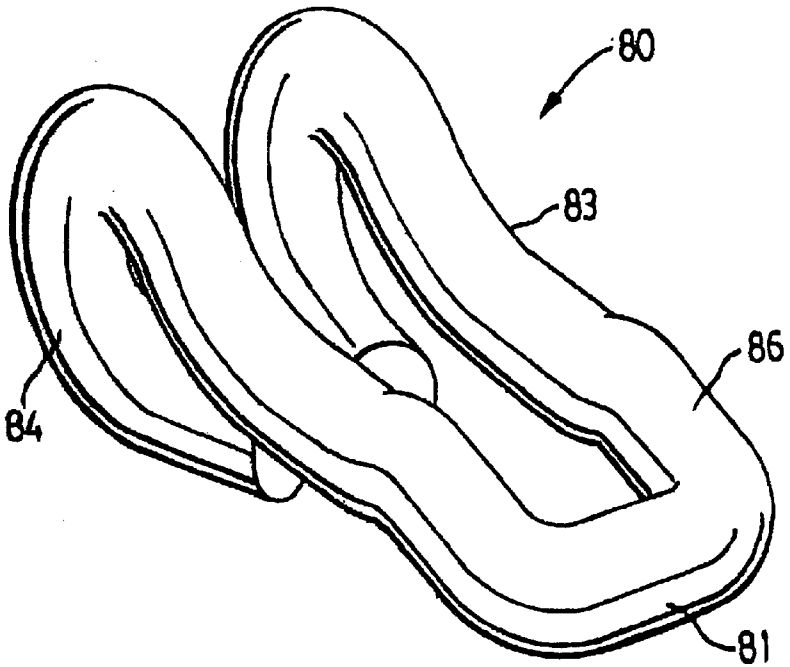
FIG. 4 shows an isometric view of the clip employed in the arrangements of FIGS. 1 to 3.
Figure 6:
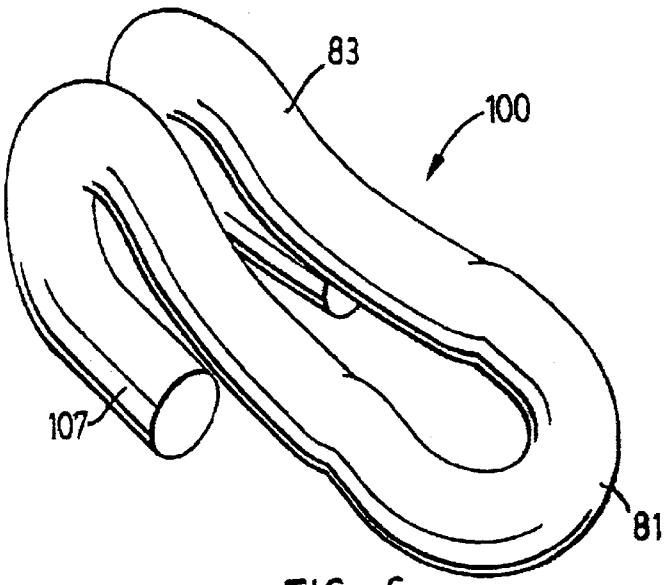
FIGS. 5, 6, 7 and 8 show top, isometric, side and front views of a second embodiment of a rail clip in accordance with the invention.
Figure 8:
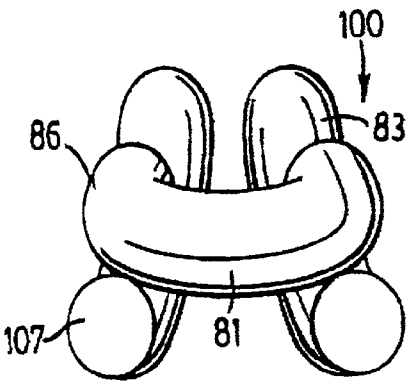
Figure 5:
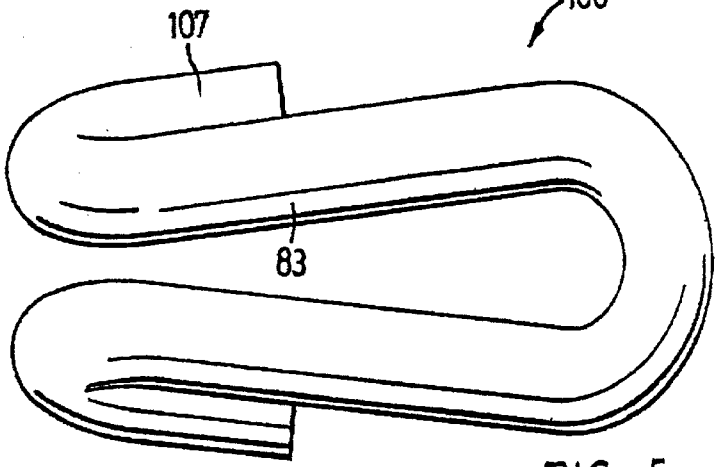

As seen in more detail in FIG. 4, the clip 80 is of bent rod form. This bent rod clip 80 has an advantage over similar plate form clips that it is not subject to failure by delamination. The clip 80 is symmetrical about a vertical plane 82, indicated in FIG. 2, extending laterally of the rail 30, with the inner portion 81 for bearing on the rail flange, intermediate limb portions 83 for engaging upwardly on the downwardly facing abutment surface such as surface 62, and an outer portion 84 curving laterally arcuately outwardly and downwardly and for bearing on a bearing surface such as an upper surface 66 of the extension 62 or 72.

In the installed condition, as seen in FIGS. 1 to 3, the downwardly facing abutment surface, for example surface 62, engages the intermediate portions 83 of the clip 80 and the downward reaction with the surface 62 flexes the portions 83 downwardly with respect to the inner and outer portions 81 and 84. There is therefore corresponding upward reaction at the inner and outer portion 81 and 84. The reaction at the inner portion 81 applies a toe load to the flange 31 while the outer portion 84 tends to flex resulting in compression of the outer portion.

It has been formed that this arrangement results in surprisingly excellent stress distribution and avoids stress concentrations that would tend to lead to premature failure of the clip. It is believed that the stress distribution results from the stress reversals that occur through the length of the clip 80. That is to say at the inner and outer portions 81 and 84 there are upward reactions on the clip 80 while in the intermediate portion 83 there is a downward reaction acting on the clip. The stress distribution is further improved by having the lower portion of the outer portions 84 bear on the bearing surface 63 along a substantial part of their length, as best seen in FIG. 1, at a region that is offset laterally inwardly from the centre of curvature of the outer portion 84.

Figure 7:
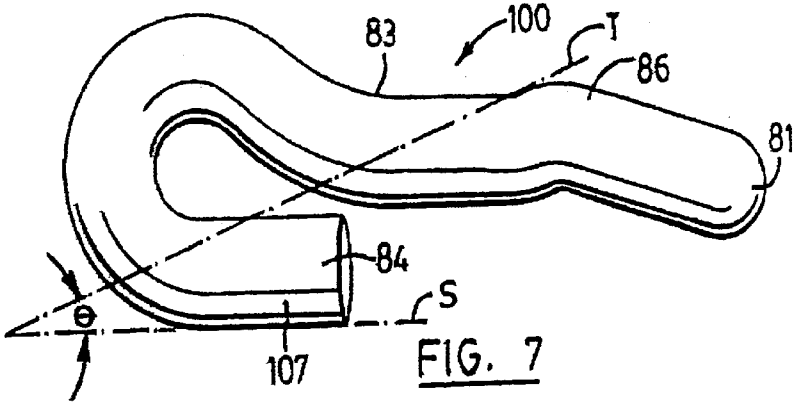

In preferred form, the inner portion 81 of the clip 80 includes upwardly bowed portions 86 that reacts with the surface 62 to provide a reaction having an inwardly directed component of force on uplift of the rail flange 31, so that vertical vibration or oscillation of the flange 31 creates forces tending to resist migration of the clip 80 outwardly from the shoulder 60 or 70. Desirably, in the non-compressed or free, non-installed condition of the clip 80 as best seen in FIG. 7, a sloping side of the upwardly bowed portion 86 at its side adjacent the surface 63, defines with the lower side of the lower portion 107 (or a line S drawn tangential to the lowermost portion thereof) a positive angle θ. That is, lines T and S intersect at a point laterally outwardly of portion at an angle greater than 0° and less than 90°, preferably about 10° to 30°, more preferably about 15° to about 25°, and still more preferably about 20°.

In the preferred form, each lower portion 84, as best seen in FIG. 2 inclines longitudinally with respect to the vertical plane 82, so that during installation, when the clip 80 is driven inwardly through the opening 61 or 71, the portions 84 can twist sideways relative to the remainder of the clip 80, so that the lower outer portion of the clip 80 compresses or squats. This renders the clip 80 particularly compliant and easy to install. In the example illustrated in FIGS. 1 to 4, the portions 84 are toed inwardly. Once installed, the clip 80 of FIGS. 1 to 4 resists rail uplift since squatting is limited by the portions 84 approaching and touching one is another.

In a preferred form of clip 100, shown in FIGS. 5 to 8 the lower portions 107 are toed outwardly. This arrangement provides a wider footprint and greater stability for the clip during installation, and reduces any tendency for the clip to spring outwardly from the shoulder when driven inwardly relative to the shoulder. The clip 100 is otherwise similar to that described above with reference to FIGS. 1 to 4. Clip 100 may be used with shoulders having extensions such as extensions 63, having anti-squat side wall members, such as raised walls 108 as seen in FIG. 3, disposed longitudinally outwardly from lower portions 107. The walls 108 limit outward movement of portions 107 and limit the extent of squatting when uplift of the flange 31 occurs.

Figure 9:
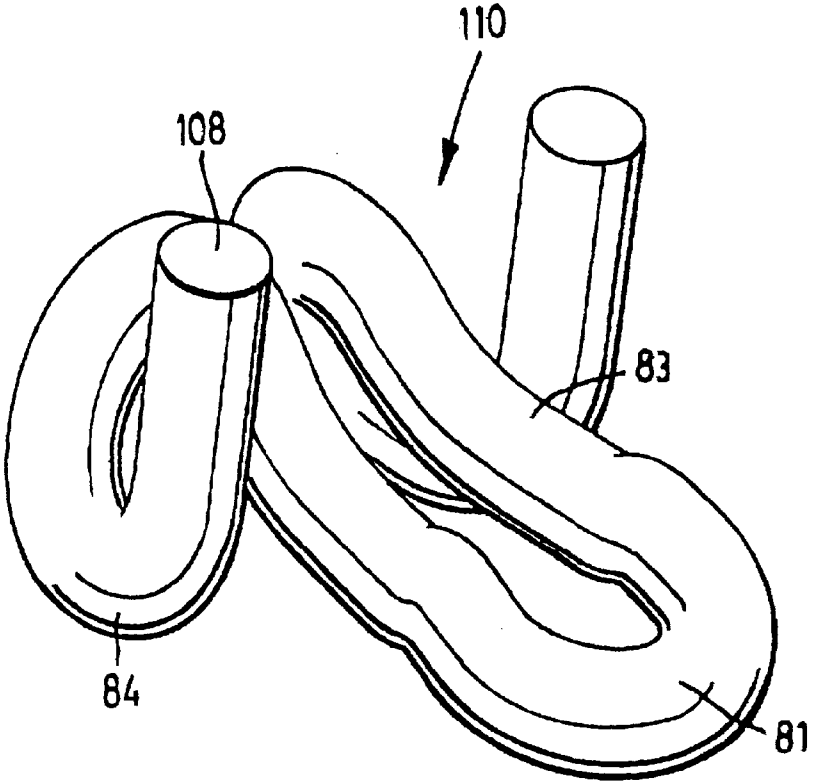
FIG. 9 (which appears on the same sheet as FIG. 4) shows an isometric view of a third embodiment of the rail clip.

Clip 110 shown in FIG. 9 is similar to clips 100 except extensions of lower portion 84 or end portions 108 extend upwardly and abut the outer side of the shoulder and extend above the upper edge of the shoulder such as shoulder 60 in the installed position. The exposed upper ends of the portion 108 may be engaged by tools to facilitate removal of the clips when desired.

In use the clips 80, 100 and 110 may be installed by laying their inner ends 81 loosely in the openings 61 or 71 and driving the clips inwardly with an inwardly directed force applied to the end of the outer portions until the upwardly bowed portion snaps past downwardly facing abutment surface such as surface 62 as the inner end portion 81 rides up the flange 31 or pre-installed insulator 90, and the intermediate portion 83 is flexed resiliently downwardly.

What is claimed is:

1. A rail retaining device comprising a shoulder member for bearing on a lateral side of a rail flange, and providing a downwardly facing abutment surface, and a rail clip in the form of a bent rod symmetrical about a vertical plane for extending laterally of the rail and having an inner portion for bearing on the rail flange in an installed position, intermediate limb portions for bearing upwardly on the downwardly facing abutment surface, and an outer portion connected to each intermediate limb portion for extending outwardly from said abutment surface and curbing laterally arcuately outwardly and outwardly toward a lower portion adapted to bear on a bearing surface, and wherein in said installed position there is a reaction between the intermediate limb portions and the downwardly facing abutment surface flexing the intermediate limb portions resiliently downwardly;

wherein each lower portion inclines longitudinally with respect to said vertical plane; and wherein each lower portion inclines longitudinally outwardly in a direction laterally inwardly.

2. A device according to claim 1 wherein the lower portion of each side of said clip is adapted to bear on said bearing surface at a region thereof which is offset laterally inwardly from a centre of curvature of said outer portion of each side of said clip.

3. A device according to claim 1 wherein the inner portion of the clip comprises an upwardly bowed portion that is adjacent the abutment surface in the installed position.

4. A device according to claim 3 wherein in a free, non-installed condition of the clip, said upwardly bowed portion defines a positive angle with a lower bearing surface of said lower portion.

5. A device according to claim 1 including a wall member connected to the shoulder member longitudinally outwardly from each lower portion for limiting outward movement thereof.

6. A device according to claim 1 wherein each lower portion continues in an upward and inward extension that extends above an upper edge of the shoulder member in the installed position.

* * * * *